US008245950B2

(12) United States Patent
Burkhardt et al.

(10) Patent No.: US 8,245,950 B2
(45) Date of Patent: Aug. 21, 2012

(54) REMOVABLE RAIL SEAL

(75) Inventors: Bruce E. Burkhardt, Conestogo (CA); Richard T. Ellis, Kitchener (CA)

(73) Assignee: Polycorp Ltd., Toronto (CA)

( * ) Notice: Subject to any disclaimer, the term of this patent is extended or adjusted under 35 U.S.C. 154(b) by 114 days.

(21) Appl. No.: 12/826,742

(22) Filed: Jun. 30, 2010

(65) Prior Publication Data

US 2012/0000988 A1 Jan. 5, 2012

(51) Int. Cl.
*E01B 21/00* (2006.01)

(52) U.S. Cl. ..... 238/8; 238/7; 238/9

(58) Field of Classification Search ..... 238/8, 2, 238/3, 379, 381

See application file for complete search history.

(56) References Cited

U.S. PATENT DOCUMENTS

| | | | | |
|---|---|---|---|---|
| 4,793,545 | A | 12/1988 | Raymond | |
| 5,655,711 | A | 8/1997 | Hull et al. | |
| 5,740,961 | A | 4/1998 | Bruning | |
| 5,899,379 | A | 5/1999 | Bruyn et al. | |
| 6,068,195 | A | 5/2000 | Gaudet | |
| 6,129,288 | A | 10/2000 | Petersen et al. | |
| 6,213,407 | B1 | 4/2001 | Ellis et al. | |
| 6,293,473 | B1 | 9/2001 | Ortwein et al. | |
| 6,401,318 | B1 * | 6/2002 | Bruyn | 29/271 |
| 6,726,116 | B2 | 4/2004 | Hofstetter, Sr. | |
| 6,764,021 | B1 | 7/2004 | Birt et al. | |

* cited by examiner

*Primary Examiner* — S. Joseph Morano
*Assistant Examiner* — Zachary Kuhfuss
(74) *Attorney, Agent, or Firm* — Marshall & Melhorn LLC

(57) ABSTRACT

A rail seal for sealing the gap between a rail and the surrounding surface material in a rail crossing or track construction, wherein the rail seal is removable from the gap and can be re-installed in the gap without damaging the surrounding surface material. More particularly, the rail seal is formed with an integral hinge element that has a closed position and an open position wherein an upper portion of the rail seal is released from and extends upwardly away from a lower portion of the seal body thereby imparting additional flexibility to the seal body. To remove the rail seal from the gap adjacent the rail, the rail seal can be manipulated so as to be pulled free from the gap. In order to re-install the rail seal, the additional flexibility provided by the hinge element allows the rail seal to be manipulated and deformed as required so as to be re-installed within the open gap. The rail seal may also be formed with anchor recesses at opposed ends of the rail seal body for receiving anchoring keys which help to secure the rail seal within the gap so as to prevent longitudinal movement and shifting of the rail seal over time.

26 Claims, 8 Drawing Sheets

REMOVABLE RAIL SEAL

TECHNICAL FIELD

The present disclosure relates generally to a rail seal for use in rail track construction to seal the space between a rail and the surrounding road surface, wherein the rail seal is removable without disturbing the surrounding road surface so as to facilitate track repair and maintenance.

BACKGROUND

In rail track construction, two parallel steel rails are anchored perpendicularly to tie members (i.e. rail ties) for maintaining a consistent distance or gauge between the two rails. Train or streetcar wheels are generally in the form of conical, flanged wheels with the smaller diameter end of the wheel being located on the top of the rail and the larger diameter, flanged-end of the wheel being located on the inner or "gauge" side of the rail as the train or streetcar travels over the tracks. The train wheels run along the upper surfaces of the steel rails with the flanged inner end or larger diameter end of the wheel being guided along the inside edge of the track.

The design and structure of rail crossings where rail tracks intersect with or share vehicular roadways or pedestrian crossings can present certain challenges with regard to the competing requirements of rail traffic versus vehicular and/or pedestrian traffic. More specifically, the structure of rail car wheels requires that a gap be provided along the inside edge of each track to allow the larger diameter end or the flanged-end of the wheels to engage the tracks. The engagement between the flanged-end of the wheel with the inside edge of the rail ensures that the train stays in contact with the rails as it travels along the tracks. The gap along the inside edge of the rails that is required to accommodate the wheel flange can present certain challenges in rail track or rail crossing constructions, and especially in situations where the rails are embedded within long lengths of roadways such as in the case of streetcar track constructions where the streetcars share the same roadway as the vehicular traffic over various distances. A large gap adjacent the rails is undesirable for vehicular traffic as it creates an uneven road surface and presents certain dangers to pedestrians as well as bicycle traffic, strollers, wheel chairs, etc. More specifically, people walking across the tracks can get their shoes/heels stuck in the gap and the smaller width bicycle tires, stroller wheels and/or wheel chair wheels can get also get stuck in the gaps. Having large gaps adjacent the rails also presents the problem of possible debris build-up within the gap which can lead to derailment of a passing train or rail car.

Rail seals made of rubber or another elastomeric material are often used in the gap between the rails and the surrounding road surface to help fill and/or reduce the size of the gap adjacent the rails. The rail seals are formed with a recess or flangeway in the upper surface thereof adjacent the rail head to provide an adequate gap for receiving the flanged-end of the train wheel while still providing a generally even, continuous surface between the rails and the road surface. In the case of streetcar tracks or rail crossings where the tracks are embedded within the road surface (i.e. poured asphalt or concrete), track maintenance and repair is somewhat difficult in the sense that the surrounding road surface must be dug-up and the rail seal removed in order to gain access to the rails. Accordingly, repairs and maintenance can be quite costly in the sense that the rail seal and the surrounding road surface must be replaced.

Accordingly, there is a continuous need to improve rail track construction, especially in the area of streetcar track design, to ensure that the requirements of rail traffic, vehicular traffic and pedestrian traffic are met.

SUMMARY OF THE INVENTION

The present disclosure provides an improved rail seal for sealing the gap between a rail and a surrounding platform or road surface in a rail crossing or track construction wherein the rail seal can be removed without disturbing the surrounding road surface, thereby facilitating track repair and/or maintenance.

In accordance with one example embodiment of the present disclosure there is provided a rail seal for sealing a gap between a rail and a surrounding surface material, the rail having a rail head, a rail base and a web portion interconnecting the rail head and rail base, the rail seal comprising: an elongated elastomeric seal body; a first surface formed along the length of the seal body for generally abutting and sealing with a corresponding side of the web portion of the rail; a second surface formed along the length of the seal body generally opposite to the first surface, the second surface generally abutting and sealing with a corresponding edge of the surrounding surface material; an upper surface formed along the length of the seal body, the upper surface extending between the rail head and the upper surface of the corresponding surrounding surface material; and a hinge element formed in the second surface of the seal body along the length thereof, the hinge element having: a first, generally closed position wherein the second surface is a generally continuous surface; and a second, open position wherein the hinge element releases an upper portion of the seal body from a lower portion of the seal body, the upper portion being angled upwardly with respect to the lower portion and being rotatable about the hinge element from said open position to said closed position.

In accordance with another example embodiment of the present disclosure there is provided a rail seal for sealing a gap between a rail and a surrounding surface material in a track construction, the surface material being a poured surface material, the rail having a rail head, a rail base and a web portion interconnecting the rail head and rail base, wherein the rail seal comprises: an elongated elastomeric seal body, the seal body having opposed ends; a first surface formed along the length of the seal body for generally abutting and sealing with a corresponding side of the web portion of the rail; a second surface formed along the length of the seal body generally opposite to the first surface, the second surface generally abutting and sealing with a corresponding edge of the surrounding surface material; an upper surface formed along the length of the seal body, the upper surface extending generally between the rail head and the upper surface of the corresponding surrounding surface material; and at least one anchor recess formed in the second surface of the elongate seal body, the at least one anchor recess forming a void within the seal body for receiving an anchoring key to secure the seal body within the gap formed between the rail and the surrounding poured surface material.

BRIEF DESCRIPTION OF THE DRAWINGS

Embodiments of the present disclosure will now be described, by way of example only, with reference to the attached Figures, wherein.

DETAILED DESCRIPTION OF THE EXAMPLE EMBODIMENTS

Figure 1:
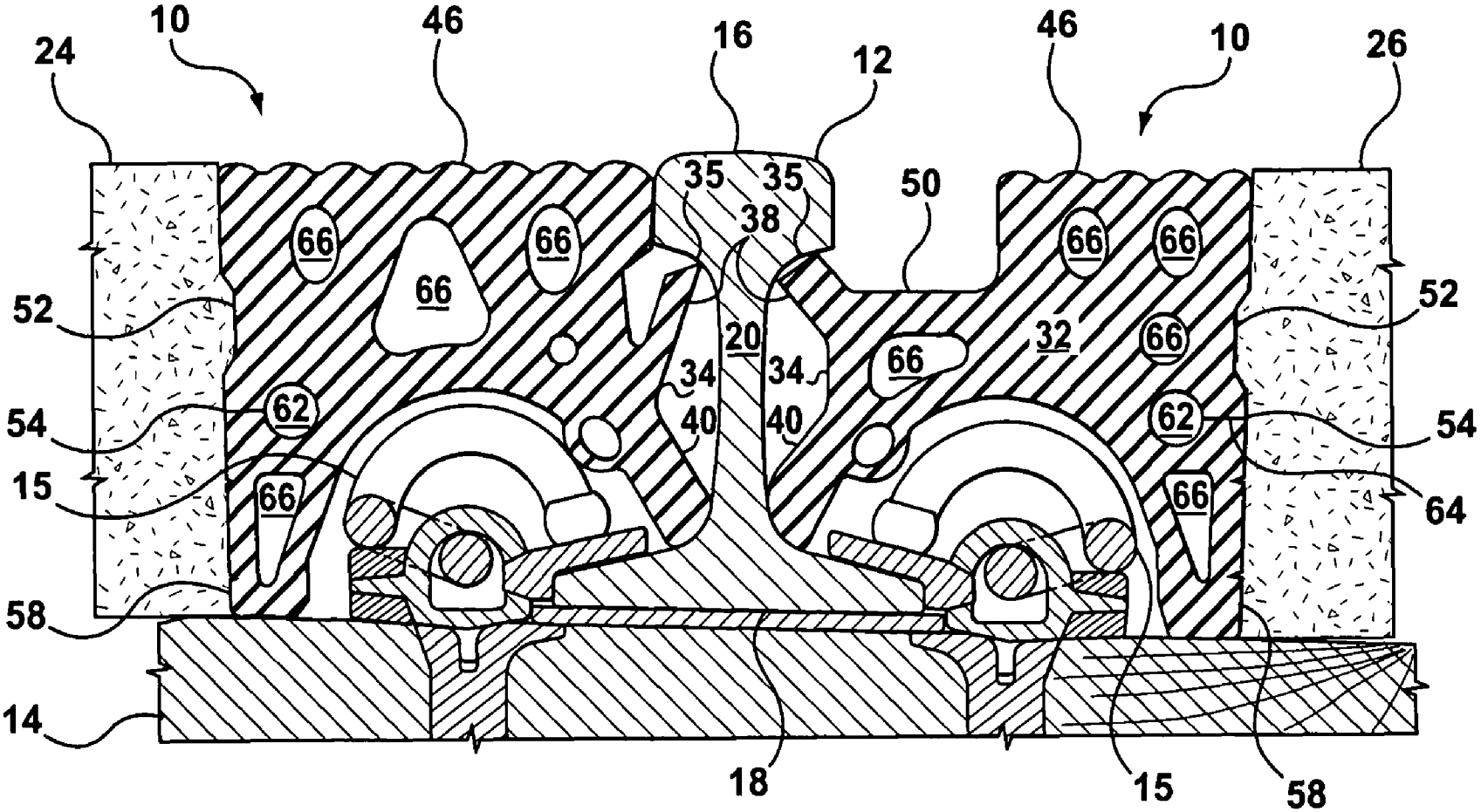
FIG. 1 is a detail cross-sectional view of a portion of a rail track crossing structure incorporating a rail seal according to an example embodiment of the present disclosure.

Referring now to the drawings, there is shown in FIG. 1 a cross-sectional view of a portion of a railway crossing structure incorporating a rail seal 10 according to an example embodiment of the present disclosure. While the description may refer generally to a railway crossing structure, it will be understood that the present disclosure is intended to cover various types of rail crossing structures and rail track constructions, including but not necessarily limited to streetcar crossings and/or streetcar track design.

The railway crossing structure shown in FIG. 1 includes two parallel rails 12 (only one of which is shown) which are anchored to transverse members or rail ties 14 and secured in place by rail clips 15. The transverse members or rail ties 14 ensure that a consistent distance or "gauge" is maintained between the rails along the length of the track. The rail 12 is generally in the form of a modified I-beam with each rail 12 having a rail head 16, a base flange 18 and a web portion 20 interconnecting the rail head 16 and the base flange 18. In standard rail designs, the rail head 16 typically has a height in the range of about 1.25-1.5 inches. At railway (or streetcar) crossings wherein other vehicular traffic and/or pedestrian traffic has access to or is required to cross share the tracks, poured asphalt or concrete, or any other suitable surrounding material, are generally used around and in-between the rails to provide a generally even, continuous surface across the rails to facilitate the crossing of or the sharing of the roadway with vehicular and/or pedestrian traffic.

In the example embodiment shown in FIG. 1, a rail seal 10 is positioned on the gauge side and on the field side of each rail 12, with the rail seal 10 positioned on the inside of the rail 12 being referred to as the "gauge-side rail seal" and the rail seal being positioned on the outside of the rail 12 being referred to as the "field-side rail seal". Both the gauge-side and field-side rail seals 10 are generally similar in structure and have similar features which will be referred to using similar reference numerals where appropriate. The surrounding road surface is formed of poured concrete or asphalt and forms the road or crossing surface on the outer or field side of each rail 12 as well as in the space between the pair of rails 12. Accordingly, the field side road surface 24 generally abuts the field-side rail seal 10 with the gauge-side road surface 26 filling the space between the rails 12 and generally abutting the corresponding gauge side rail seal 10. The road surfaces 24, 26 and the gauge side and field side rail seals 10 provide a generally even and continuous surface across the track construction or rail crossing for vehicular and/or pedestrian traffic travelling over or across the rails.

Rail seals, in general, are formed of an elastomeric material using an extrusion process with the rail seals being formed in sections having lengths in the range of 5 to 16 ft. However, it will be understood that the lengths of the rail seals may vary depending on the particular design and application of the rail seal and may also vary due to customer preference. The individual lengths of rail seal are often clipped together end-to-end to form the required length of rail seal for a particular section of track. The rail seals are positioned adjacent to and generally abut either side of the rail with the surrounding road or crossing surface being poured in the areas between and surrounding the rails. In some instances, the rail seals are also held in position adjacent the rail by means of the rail fasteners as well as by the surrounding road or crossing surface. Some difficulties associated with rail seals of this type are that the rail seals cannot be easily removed and replaced without replacing the corresponding surrounding road or crossing surface material. Difficulties have also been encountered with rail seals of this type shifting or separating from the rails due to thermal expansion and contraction of the rail seal as well as mechanical forces from the road traffic. The result can be large gaps between the individual lengths of rail seal resulting in large holes in the roadway, similar to potholes.

In the example embodiment shown in FIG. 1, both the gauge-side and field-side rail seal 10 comprise a generally elongated seal body 32. The seal body has a first surface 34 formed along the length of the seal body 32 for generally abutting and sealing against the web portion 20 of the corresponding rail 12. A second surface 36 is formed along the length of the seal body 32 opposite to the first surface 34, the second surface 36 for generally abutting and sealing against the corresponding edge of either the field-side or gauge-side road surface 24, 26. In the subject embodiment, the first surface 34 is formed with an outwardly projecting upper leg 38 which projects generally upwardly so as to engage the underside or bottom edge 35 of the rail head 16. The first surface 34 is also formed with an outwardly projecting lower leg 40 which projects generally downwardly so as to engage and seal against the web portion 20 and base flange 18 of the rail 12. The upper leg 38 helps to ensure that the rail seal 10 is not easily dislodged out of engagement with the rail 12 and that the rail seal 10 forms an adequate seal with the rail 12. It will be understood that while a specific profile of the first surface 34 of the rail seal 10 has been described, the rail seal 10 is not intended to be limited to the specific profile described and that other profiles for the first surface 34 may also be suitable.

The seal body 32 has a lower surface 42 formed along the length of the rail seal 10 which has a profile shaped to generally accommodate the rail clips 15 and any rail tie fasteners (i.e. bolts or spikes) that are used to secure the rails 12 in place. The lower surface 42, which extends from the lower leg 40 of the first surface 34 to a corresponding lower leg portion 58 associated with the second surface 36 of the rail seal 10, has a generally concave shape to accommodate the protrusions associated with the rail clips 15 and rail tie fasteners used along the length of the rail 12. Once again, it will be understood that while a specific profile of the lower surface 42 has been described, the rail seal 10 is not intended to be limited to the specific profile described and shown in the drawings and it will be understood that other profiles for the lower surface 42 may also be suitable for use in the subject rail sail 10. For example, the figures shows a rail seal designed to accommodate a Pandrol™ "e" style track fastener, which is one of many styles of track fasteners know in the art. Rail seal profiles for alternate track fasteners will have different geometries for the various surfaces of the rail seal and are included in the scope of the subject application.

The seal body 32 has an upper surface 46 extending between the adjacent field-side or gauge-side road surface 24, 26 and the rail head 16 of the corresponding rail 12. In the field-side rail seal 10, the upper surface 46 extends between the edge of the field-side road surface 24 to the rail head 16 of the corresponding rail 12 and lies generally in the same plane or at the same surface level as the surrounding road surface 24 and the upper surface of the rail head 16. The upper surface 46 may be ribbed or textured, or may have a generally planar surface. The upper surface 46 of the gauge-side rail seal 10 differs from the field-side rail seal in that the upper surface 46 has a recessed portion or flangeway 50 formed therein for receiving the flanged-end or large diameter end of the conically-shaped train wheel. The flangeway 50 runs generally parallel and adjacent to the rail head 16 along the length of the seal body 32. Typically, the flangeway 50 has a depth that extends below the overall height of the rail head 16 to ensure that sufficient depth is provided for receiving the flanged-end of the train wheel.

The second surface 36 of both the field-side and gauge-side rail seals 10 is generally planar and extends from the upper surface 46 of the rail seal 10 to the rail ties 14 at the bottom of the cavity or gap formed between the rail 12 and the adjacent road surface 24, 26 and, therefore, provides a generally large surface area for sealing against the corresponding edge of the surrounding road surface 24, 26. While generally planar, the second surface may include a slight recess 52 formed along the length thereof, generally in the upper half of the second surface 36, which may enhance the seal formed between the rail seal 10 and the corresponding field-side or gauge-side road surface 24, 26 when the surface material is poured against the rail seal 10 during construction. Recess 52 is also used to lock the rail seal in place so that it will tend not to lift out of the gap between the rail 12 and the surrounding road surface 24, 26. Recess 52 may also be used to accommodate the clips that hold the ends of the rail seal together.

The second surface 36 is formed with a hinge element 54 which generally divides the second surface 36 and rail seal body 32 into an upper portion 56 and a lower portion 58. In the subject embodiment, the hinge element 54 is formed as a result of a cavity passage 62 that is formed within the seal body 32 and which extends along the length thereof proximal to the second surface 36 of the seal body 32. In some embodiments, a line of weakness which extends from the second surface 36 to the cavity passage 62 is formed within the elastomeric material during the extrusion process forming the seal body 32. The line of weakness is then cut after the extrusion process to form a slit 64 extending from the second surface 36 through to the cavity passage 62. In other embodiments, the rail seal 10 and cavity passage 62 may be extruded such that the slit 64 is formed as an open, working slit at the time of manufacture. Therefore, once the hinge element 54 has been fully formed with an open, working slit 64, the seal body 32 has a closed position when the hinge 54 is closed and the second surface 36 is a generally continuous surface, and an open position wherein the upper portion 56 of the seal body 32 is released from and extends upwardly away from the lower portion 58 of the seal body 32 at an angle thereto.

Various other cavity passages 66 may be formed within the seal body 32, as is shown in the drawings. The cavity passages 66 are generally formed as a result of the extrusion process typically used to form rail seals of this type and run along the length of the seal body 32. The cavity passages 66 may also provide additional flexibility and compressibility to the rail seal 10.

During construction of the rail or street car crossing structure, the field-side and gauge-side rail seals 10 are positioned on either side of the rail 12. The surrounding road surface, whether it be poured concrete or asphalt, can then be poured to form the field-side and gauge-side road surfaces 24, 26, the road surfaces 24, 26 therefore generally abutting and sealing against the second surface 36 of the corresponding field-side or gauge-side rail seal 10. When track maintenance or repair is required, the rail seal 10 can be pulled and/or pried free from the gap between the rail 12 and the surrounding road surface 24, 26 due to the overall flexibility of the elastomeric seal body 32 without damaging the surrounding road surface 24, 26. Once the rail seal 10 has been removed, the tracks can be easily inspected and/or repaired as needed. The rail seal 10 can then be reinstalled within the exposed gap to return the rail tracks or crossing to their functional form as will be described in further detail below.

Figure 2:
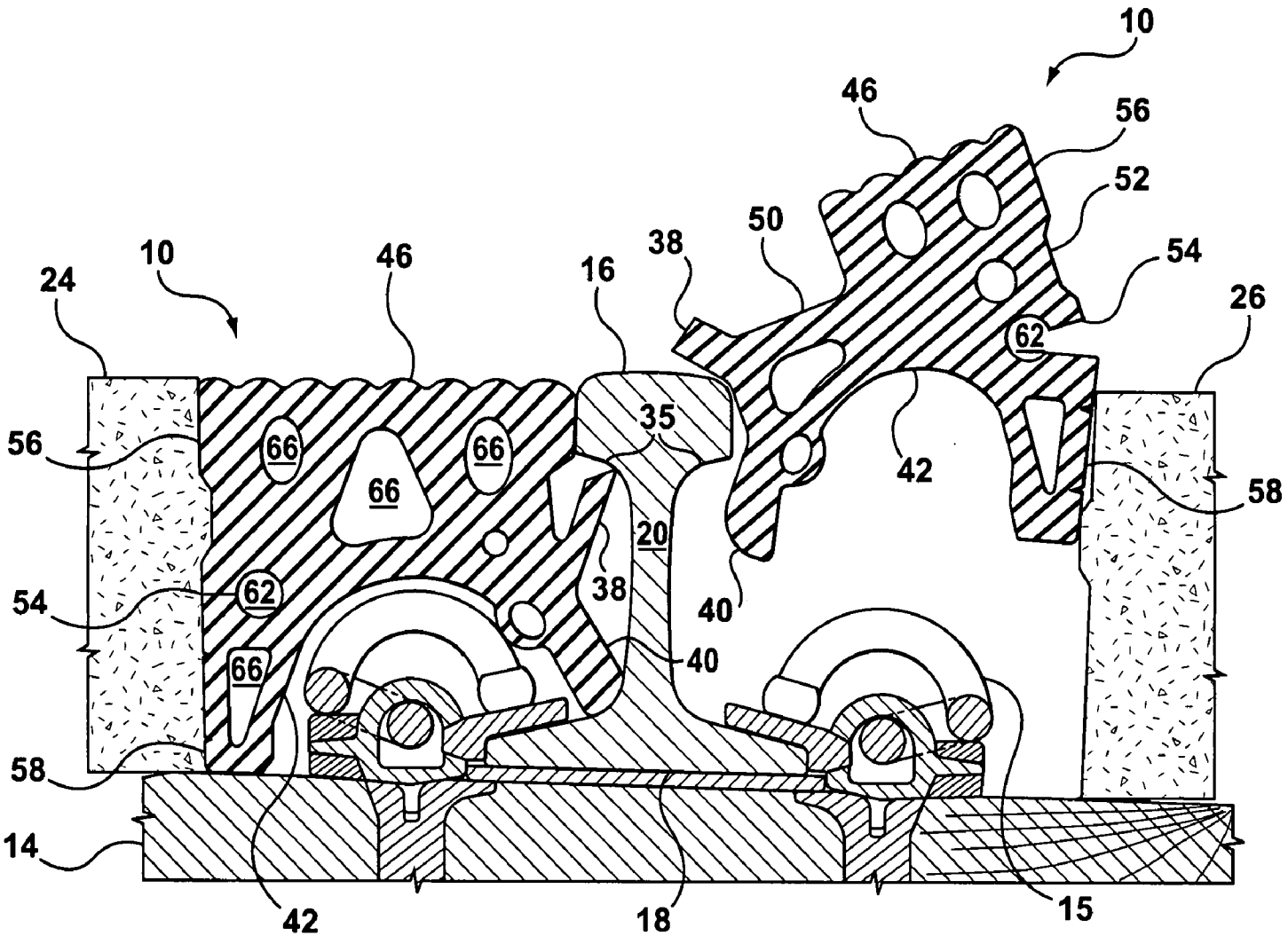
FIG. 2 is a detail cross-sectional view of the rail track crossing structure of FIG. 1 showing the rail seal being inserted into the structure.
Figure 3:
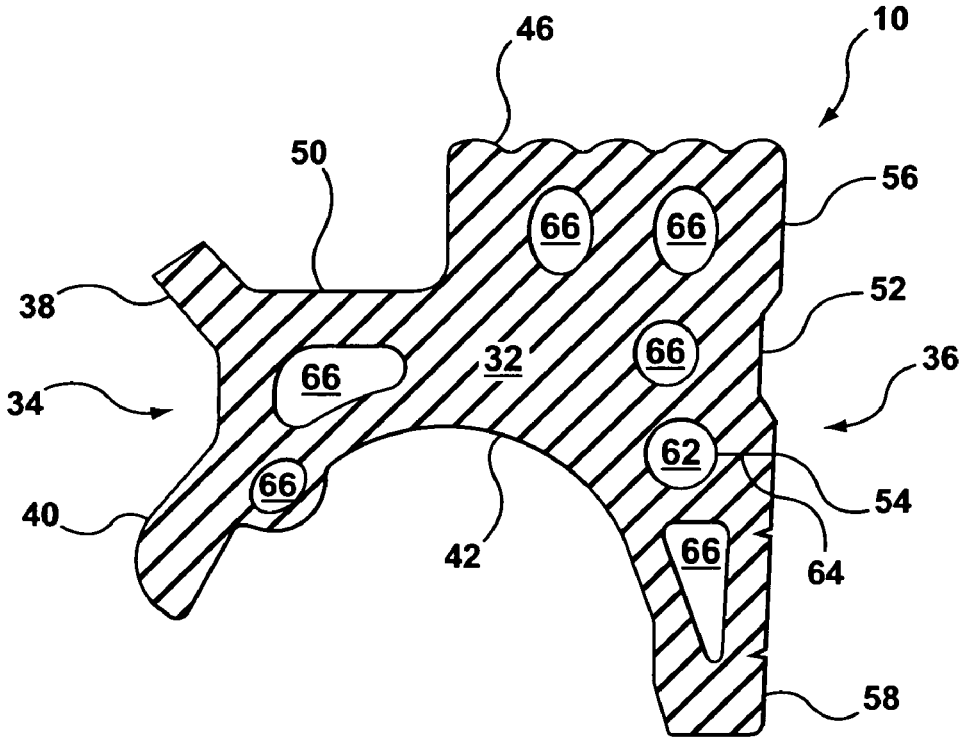
FIG. 3 is a detail cross-sectional view of the gauge-side rail seal shown in FIG. 1.
Figure 4:
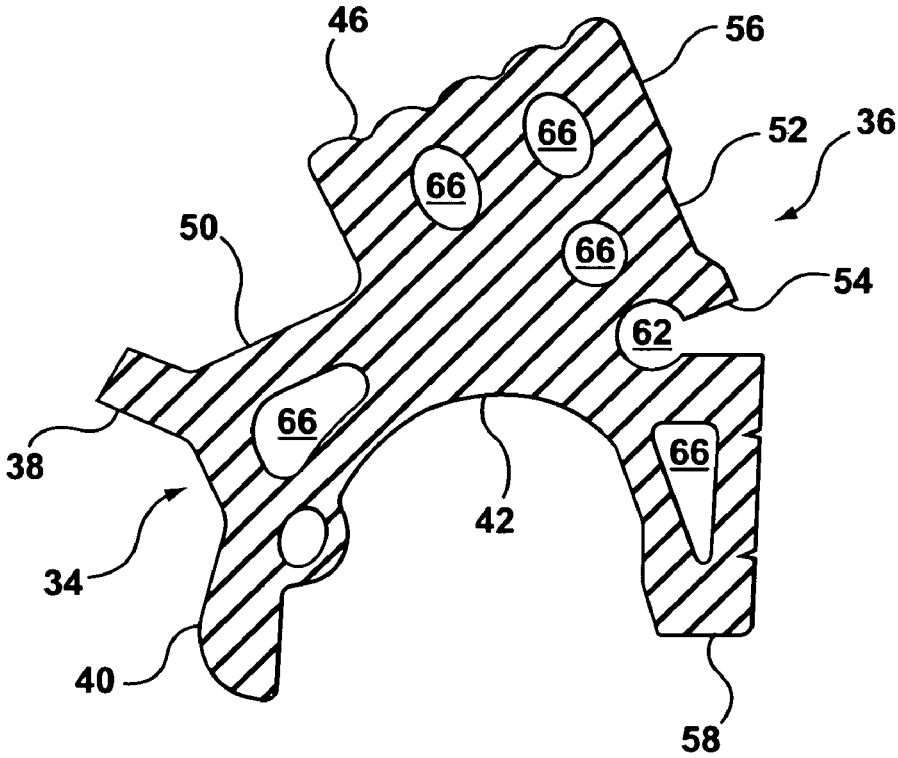
FIG. 4 is a detail cross-sectional view of the gauge-side rail seal as shown in FIG. 2.

To reinstall the rail seal 10 once it has been removed from the gap, hinge element 54 is free to move from its closed position to its open position wherein the upper portion 56 of the seal body 34 is released from the lower portion 58 with the upper portion 56 being angled upwards with respect to the lower portion 58 once the hinge element 54 has (see FIGS. 2 and 4) assumed its open position. The release of the hinge element 54 increases the overall flexibility of the rail seal body 32. The added flexibility provided to the rail seal 10 once the hinge element 54 is released to its open position enables the rail seal body 32 to be manipulated so that it can be re-inserted into the gap between the rail 12 and the surrounding road surface 24, 26. During re-installation, the lower portion 58 of the seal body 32 is inserted into the gap and is pushed or moved downwardly towards the base flange 18 of the rail 12 and the rail ties 14 at the bottom of the gap (see FIG. 4). As the lower portion 58 of the seal body moves downwardly in the gap, the upper portion 56 of the seal body 32 can be manipulated about hinge element 54 to insert the upper leg 38 of the first surface 34 underneath the bottom edge 35 of the rail head 16 so as to securely engage and rail seal 10 against the rail 12. As the seal body 32 is further inserted into and is pushed further downwardly towards the bottom of the gap, the rail seal body 32 assumes its original position (as seen in FIG. 1) with the hinge element 54 returned to its closed position. While the removal and re-installation of the rail seal 10 has been described in connection with the gauge-side rail seal 10 as shown in FIGS. 2 and 4, it will be understood that the same removal and re-installation procedures may generally be applied to removal and re-installation of the field-side rail seal 10.

Figure 5:
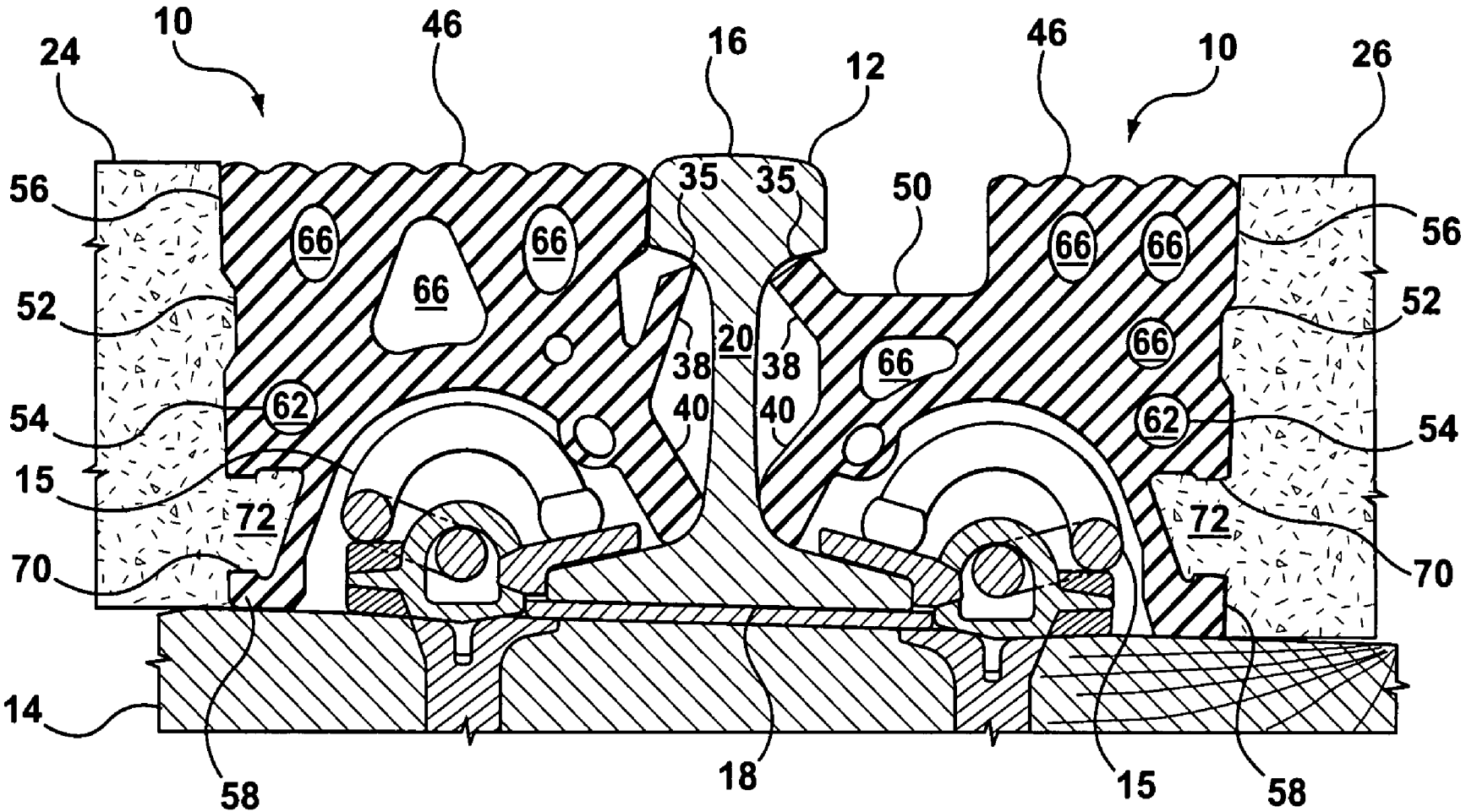
FIG. 5 is a detail cross-sectional view of a portion of a rail track crossing structure incorporating a rail seal according to another example embodiment of the present disclosure.

Referring now to FIG. 5, there is shown a section of rail seal 10 according to another example embodiment of the present disclosure wherein similar reference numerals have been used to identify similar features. In the subject embodiment, the second surface 36 of the rail seal body 32 has cut-outs or anchor recesses 70 formed in the lower portion of the seal body 32 at discrete locations along the length of the seal body 32. In one example embodiment, an anchor recess 70 is formed at each of the opposed ends of the seal body 32 proximal to the ends that are clipped together to form the rail seal 10. In other example embodiments, anchor recesses 70 may be formed at the opposed ends of the seal body 32 but may also be formed at discrete intervals therebetween. Accordingly, it will be understood that the anchor recesses 70 do not extend along the length of the seal body 32 in a continuous manner.

In the subject example embodiment, when the surface material (i.e. concrete, asphalt, etc.) is poured to form the surrounding field-side and gauge-side road surfaces 24, 26 which form the track or rail crossing structure, the surface material will enter the voids formed by anchor recesses 70 located at the opposed ends of the elongate seal body 32 and will harden or set to form anchoring keys 72. The anchoring keys 72 help to secure the seal body 32 in place which helps to reduce the tendency of the rail seal 10 to shift longitudinally over time as a result of the mechanical and thermal forces on the rail seal 10. Because the anchor recesses 70 are only formed at discrete intervals (i.e. at the opposed ends or at intervals therebetween) along the length of the seal body 32, the rail seal 10 can still be easily removed from the gap between the rail 12 and the surrounding road surface 24, 26 by applying upwards forces to the rail seal 10 as the overall flexibility of the elastomeric material allows the seal body 32 to deform so as to free itself from the anchoring keys 72, allowing the rail seal 10 to be removed and thereby providing access to the rails 12.

Figure 7:
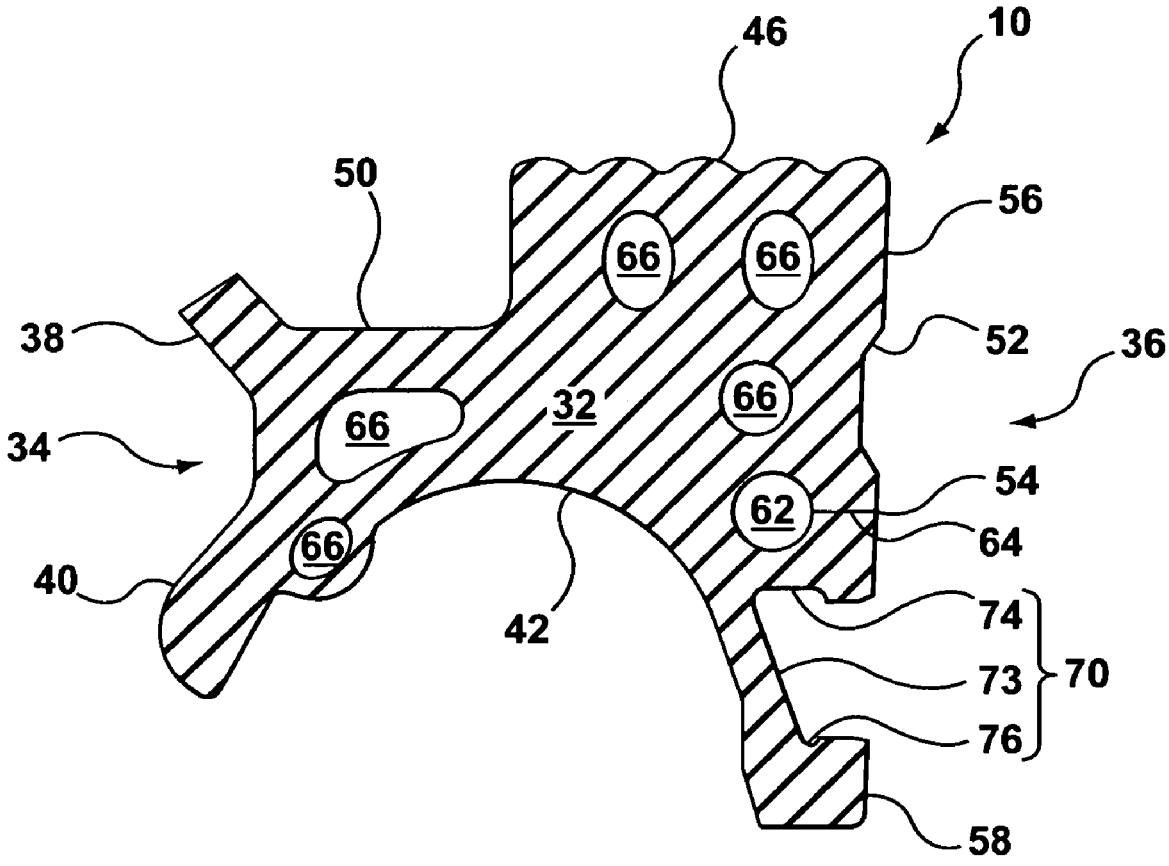
FIG. 7 is a detail cross-sectional view of the gauge-side rail seal as shown in FIG. 5.

In the subject embodiment, the anchor recesses 70 have an inner end 73 formed within the seal body 32 that is angled or tapered from a larger upper end 74 to a narrower lower end 76 (see FIG. 7). The tapering of the inner end 73 of the anchor recess 70 helps to ensure a secure connection between the poured road surface material and the seal body 32 while still allowing for removal of the seal body 32 as the angled surface tends to encourage the upward movement of the seal body 32 once the lower leg portion 58 has been released from the lower end of the anchor key 72. While anchor recesses 70 having a tapered inner end 73 have been shown, it will be understood that various other shapes of anchor recesses 70 may also be suitable and achieve the same results. Accordingly, the present disclosure is not intended to be limited to anchor recesses 70 having this particular form. For example, as mentioned above, the figures show a rail seal designed to accommodate a Pandrol™ "e" style track fastener, which is one of many styles of track fasteners known in the art. Rail seal profiles for alternate track fasteners will have different geometries of rail seal profiles and anchor recesses and are included in the scope of the subject application.

In order to reinstall the rail seal 10 formed with anchor recesses 70, once the rail seal 10 has been removed from a section of track or rail crossing, hinge element 54 opens at slit 64 to move from its initial closed position to its open position, as described in detail above in connection with the embodiment shown in FIGS. 1-4. However, in order to reinstall the rail seal 10 according to the subject embodiment, before the rail seal 10 is inserted back into the gap, the anchor recess 70 is cut along its tapered inner end 73 and the lower leg portion 58 of the seal body 32 is removed at a point slightly below the upper end 74 of the anchor recess 70. By removing the lower leg portion 58 of the seal body 32 that is associated with anchor recess 70, only a small recessed portion of the upper end 74 of the anchor recess 70 remains in what now forms part of the lower surface 42 of the seal body 32 (see FIG. 6). The rail seal 10, therefore, can be re-inserted into the gap between the rail 12 and the corresponding adjacent road surface 24, 26 without interference from the anchor keys 72 that remain in and protrude into the rail seal gap.

Figure 6:
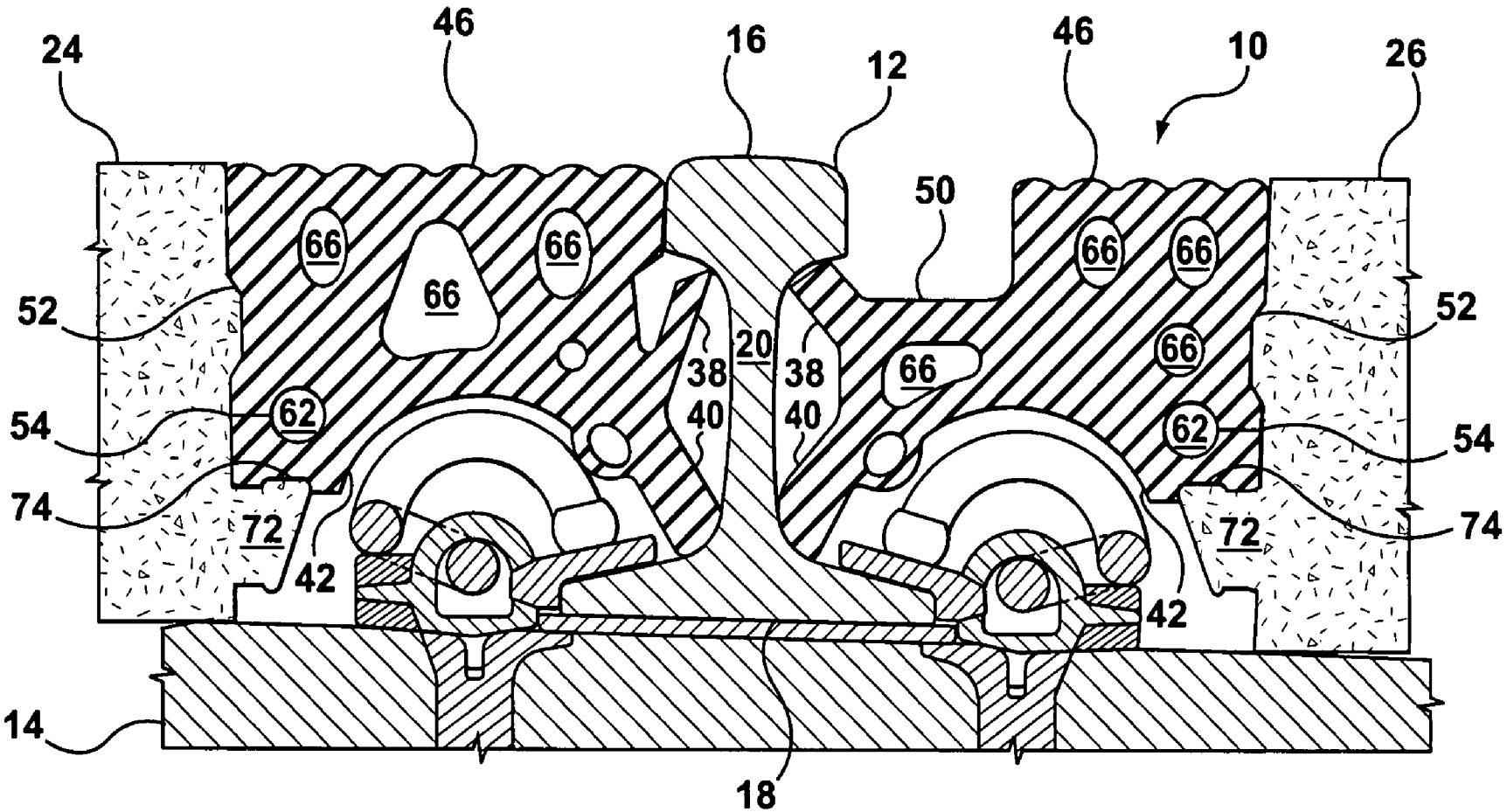
FIG. 6 is a detail cross-section view of the rail track crossing structure of FIG. 5 wherein the rail seal has been removed and reinstalled within the structure.

Once hinge element 54 has assumed its open position upon removal of the seal body 32 from the gap, the seal body 32 has sufficient flexibility to allow the seal body 32 to deform so as to be re-inserted into the gap between the rail 12 and the adjacent road surface 24, 26 as described in detail above. Once the upper leg 38 of the first surface 34 of the rail seal 10 can be manipulated and inserted underneath the bottom edge 35 of the rail head 16, the seal body 32 can then be pushed downwardly within the gap until the lower leg 40 of the first surface 34 engages the base flange 18 of the rail 12 and the remaining upper end 74 of the cutout 70 engages the corresponding upper surface of the anchoring key 72 as shown in FIG. 6. By re-installing the same rail seal 30 within the section of track or rail crossing structure, the costs associated with track repair and maintenance are greatly reduced as the surrounding road surface does not need to be dug-up or damaged and the rail seal itself does not need to be replaced with a new one.

Figure 8:
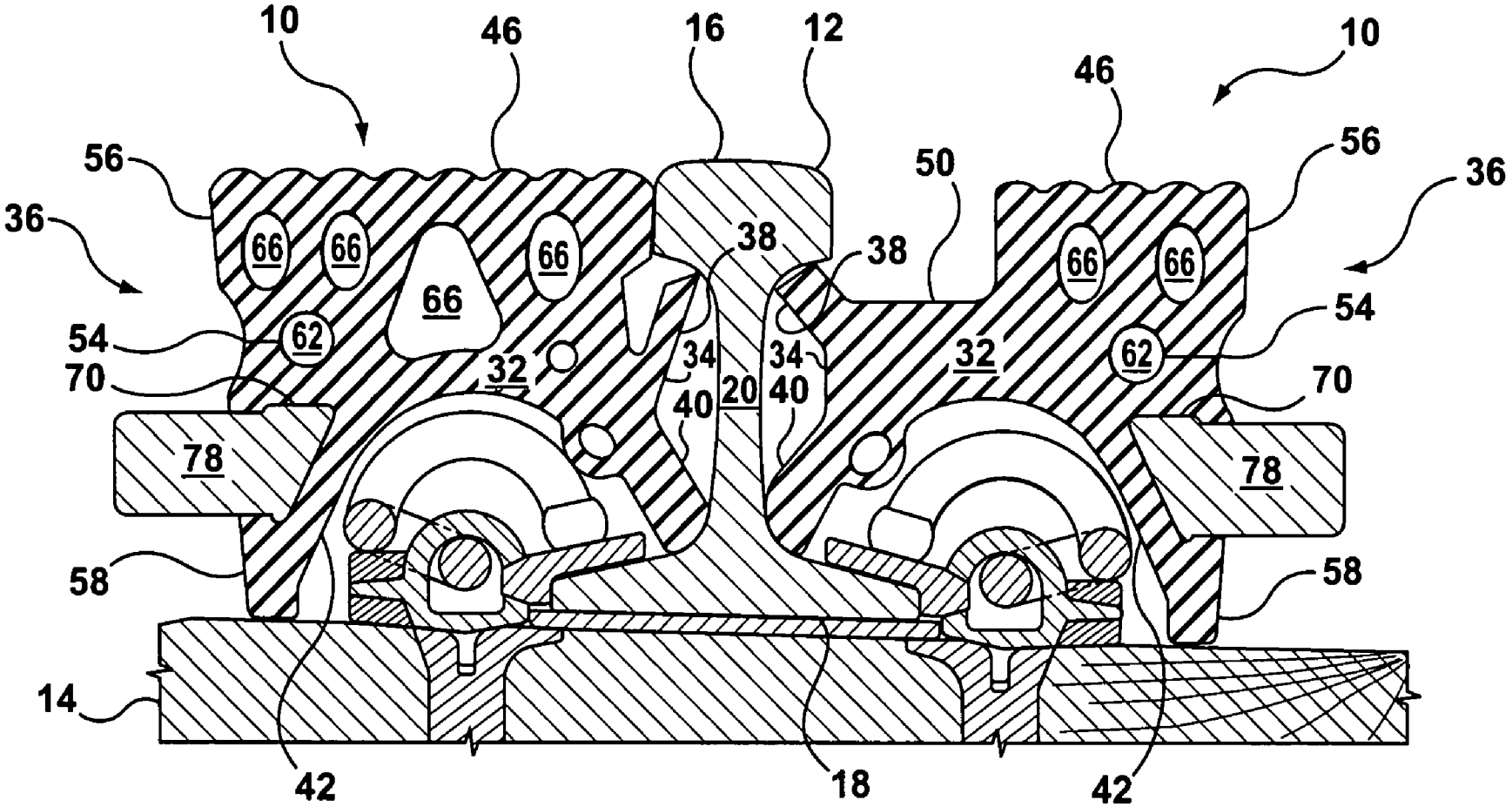
FIG. 8 is a detail cross-sectional view of a portion of a rail track assembly incorporating a rail seal according to another example embodiment of the present disclosure.
Figure 9:
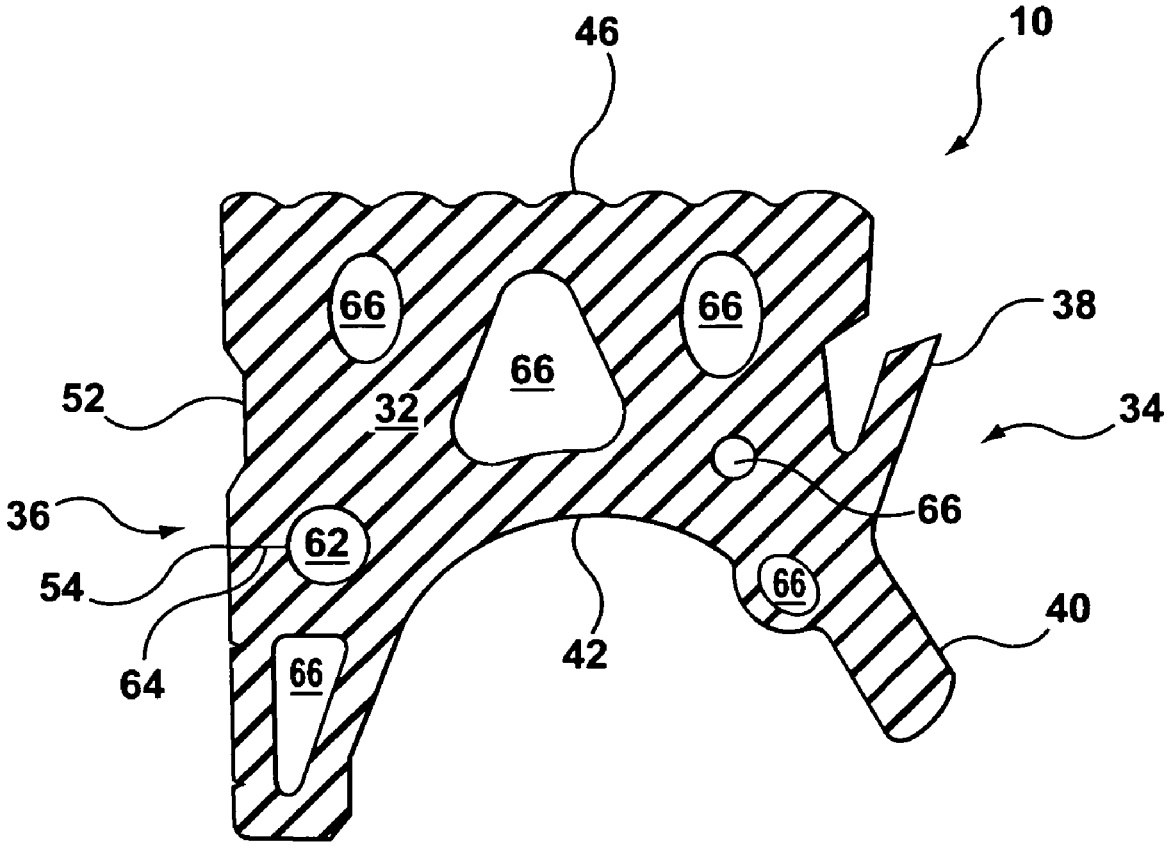
FIG. 9 is a detail cross-sectional view of the field-side rail seal shown in FIG. 1.

Referring now to FIG. 8, there is shown another example embodiment of the rail seal according to the present disclosure. In the subject embodiment, the rail seal 10 is formed with anchor recesses 70 at the opposed ends of the elongate seal body 32, or in some embodiments, at discrete intervals along the length of the seal body 32. However, rather than having anchoring keys 72 formed by the poured surface material, prior to the surrounding surface material being poured into the areas surrounding the rails 12, anchor inserts 78 are inserted into the anchor recesses 70 and engage the inner end 73 thereof. The anchor inserts 78 protrude outwardly from the anchor recesses 70 beyond the second surface 36 of the seal body 32 and act as the previously described anchoring keys 72. Therefore, in this example embodiment, rather than having the poured surface material enter and fill the voids formed by the anchor recesses 70 to form anchoring keys 72 as is described above, the protruding portions of the anchor inserts 78 become encapsulated in and thereby engage the surrounding surface material 24, 26 as it is poured into the areas surrounding the rails 12. The engagement between the anchor inserts 78 and the surrounding material 24, 26 helps to secure and anchor the rail seals 10 within the gap and helps to prevent longitudinal movement or shifting of the rail seal 10 within the gap due to the mechanical and thermal forces and stresses on the rail seal 10 over time. Accordingly, the anchor inserts 78 function in a similar manner to the anchor keys 72 described above in connection with the embodiment shown in FIGS. 5 and 6.

In terms of removing and reinserting the rail seal 10 with anchor inserts 78 shown in FIG. 8, it will be understood that the same procedures as described above in connection with FIGS. 5 and 6 apply to the subject example embodiment as the seal body 32 is removable over the anchor inserts 78 in the same manner as the seal body 32 is removed from the anchoring keys 72 formed by the poured surface material.

Furthermore, it will be understood that while the use of anchor recesses 70 and anchor keys 72 or anchor inserts 78 have been described in connection with example embodiments of rail seals 10 that also incorporate a hinge element 54, the feature of the anchor recesses 70 and anchor keys 72 or anchor inserts 78 may also be incorporated into rail seals that do not necessarily include hinge element 54.

The various embodiments presented above are merely examples and are in no way meant to limit the scope of this disclosure. Variations of the innovations described herein will be apparent to persons of ordinary skill in the art, such variations being within the intended scope of the present application. The subject matter described herein and in the recited claims intends to cover and embrace all suitable changes in technology.

The invention claimed is:

1. A rail seal for sealing a gap between a rail and a surrounding surface material, the rail having a rail head, a rail base and a web portion interconnecting the rail head and rail base, the rail seal comprising:

an elongated elastomeric seal body;

a first surface formed along the length of the seal body for generally abutting and sealing with a corresponding side of the web portion of the rail;

a second surface formed along the length of the seal body generally opposite to the first surface, the second surface generally abutting and sealing with a corresponding edge of the surrounding surface material;

an upper surface formed along the length of the seal body, the upper surface extending between the rail head and the upper surface of the corresponding surrounding surface material; and a hinge element formed in the second surface of the seal body, the hinge element having a closed position and an open position, the hinge element comprising:

a slit formed within the elastomeric material of the seal body, the slit having opposed faces, the opposed faces being in face-to-face contact when the hinge element is in said closed position, the second surface thereby forming a generally continuous surface.

2. A rail seal as claimed in claim 1, wherein the hinge element further comprises:

a cavity passage formed within the seal body and extending along the length thereof the slit extending between the second surface through to the cavity passage.

3. A rail seal as claimed in claim 1, wherein the rail seal is removable from the gap formed between the rail and the corresponding surrounding surface material by means of generally upwards forces and manual manipulation of the seal body.

4. A rail seal as claimed in claim 3, wherein the hinge element permits re-installation of the rail seal within the gap once the hinge element has been brought into the open position.

5. A rail seal as claimed in claim 1, wherein the upper surface is formed with a flangeway for receiving a flanged wheel of a rail car, the flangeway extending along the length of the seal body generally parallel to and adjacent the rail head, the rail seal being a gauge-side rail seal.

6. A rail seal as claimed in claim 5, wherein the flangeway lies generally in a plane below the rail head of the rail.

7. A rail seal as claimed in claim 1, wherein the rail seal is a field-side rail seal, the upper surface of the rail seal therefore extending between the corresponding edge of the adjacent surrounding surface material and the rail head, the upper surface lying generally in the same plane as the upper surface of the surrounding surface material and the upper surface of the rail head.

8. A rail seal as claimed in claim 1, wherein the first surface has an upper leg extending generally upwardly and outwardly therefrom for engaging a bottom edge of the rail head, and a lower leg extending generally downwardly and outwardly therefrom for abutting and engaging the base flange of the rail.

9. A rail seal as claimed in claim 1, wherein at least one anchor recess is formed in the second surface of the elongate seal body, the at least one anchor recess forming a void within the seal body for receiving an anchoring key to secure the seal body within the gap formed between the rail and the surrounding poured surface material.

10. A rail seal as claimed in claim 9, wherein the anchoring key is formed by poured surface material entering the void formed by the anchor recess within the seal body when the surface material is poured against the rail seal to form the surrounding surface material.

11. A rail seal as claimed in claim 9, wherein the anchoring key is in the form of an anchor insert inserted into the at least one anchor recess, the anchor insert protruding outwardly from the second surface of the seal body.

12. A rail seal as claimed in claim 1, wherein the seal body has an upper portion and a lower portion separated by said hinge element, the upper portion and lower portion each defining one of the opposed faces of said slit, the upper portion rotating about said hinge element with respect to said lower portion bringing said opposed faces out of face-to-face contact when said hinge element is in said open position.

13. A rail seal as claimed in claim 1, wherein the seal body has an upper portion and a lower portion separated by said hinge element, the upper portion being angled upwardly with respect to the lower portion and being rotatable about the hinge element from said open position to said closed position.

14. A rail seal for sealing a gap between a rail and a surrounding surface material in a track construction, the surface material being a poured surface material, the rail having a rail head, a rail base and a web portion interconnecting the rail head and rail base, wherein the rail seal comprises:

an elongated elastomeric seal body, the seal body having opposed ends;

a first surface formed along the length of the seal body for generally abutting and sealing with a corresponding side of the web portion of the rail;

a second surface formed along the length of the seal body generally opposite to the first surface, the second surface generally abutting and sealing with a corresponding edge of the surrounding surface material;

an upper surface formed along the length of the seal body, the upper surface extending generally between the rail head and the upper surface of the corresponding surrounding surface material; and at least one anchor recess formed in the second surface of the elongate seal body, the at least one anchor recess forming a void within the seal body for receiving an anchoring key to secure the seal body within the gap formed between the rail and the surrounding poured surface material.

15. A rail seal as claimed in claim 14, wherein the anchoring key is formed by poured surface material entering the void formed by the anchor recess within the seal body when the surface material is poured against the rail seal to form the surrounding surface material.

16. A rail seal as claimed in claim 14, wherein an anchor recess is formed at each opposed end of the elongate seal body.

17. A rail seal as claimed in claim 14, wherein the at least one anchor recess has a tapered inner end formed within the seal body, the tapered inner end extending between a larger upper end and a smaller, lower end.

18. A rail seal as claimed in claim 14, wherein the anchoring key is in the form of an anchor insert inserted into the at least one anchor recess, the anchor inserts protruding outwardly from the second surface of the seal body.

19. A rail seal as claimed in claim 14, wherein the rail seal further comprises:

a hinge element formed in the second surface of the seal body, the hinge element having a closed position and an open position, the hinge element comprising:

a slit formed within the elastomeric material of the seal body, the slit having opposed faces, the opposed faces being in face-to-face contact when the hinge element is in said closed position, wherein the hinge element is located at a level which lies generally above the anchor recesses.

20. A rail seal as claimed in claim 19, wherein the hinge element further comprises:

a cavity passage formed within the seal body and extending along the length thereof the slit extending between the second surface through to the cavity passage.

21. A rail seal as claimed in claim 19, wherein the anchor recess is deformable over the anchoring key to permit removal of the seal body from the gap formed between the rail and the corresponding surrounding surface material by means of generally upwards forces and manual manipulation of the seal body.

22. A rail seal as claimed in claim 19, wherein the rail seal can be reinstalled within the gap formed between the rail and the corresponding surrounding surface material by bringing the hinge element into the open position and by removing a lower portion of the anchor recess, the lower portion being removed along the length of the seal body.

23. A rail seal for sealing a gap between a rail and a surrounding surface material, the rail having a rail head, a rail base and a web portion interconnecting the rail head and rail base, the rail seal comprising:

an elongated elastomeric seal body;

a first surface formed along the length of the seal body for generally abutting and sealing with a corresponding side of the web portion of the rail;

a second surface formed along the length of the seal body generally opposite to the first surface, the second surface generally abutting and sealing with a corresponding edge of the surrounding surface material;

an upper surface formed along the length of the seal body, the upper surface extending between the rail head and the upper surface of the corresponding surrounding surface material; and a hinge element formed in the second surface of the seal body, the hinge element having a closed position and an open position, the hinge element comprising:

a cavity passage formed within the seal body and extending along the length thereof; and a slit formed within the elastomeric material of the seal body, the slit extending between the second surface through to the cavity passage and having opposed faces, the opposed faces being in face-to-face contact when the hinge element is in said closed position, wherein the rail seal is a field-side rail seal, the upper surface of the rail seal extending between the corresponding edge of the adjacent surrounding surface material and the rail head, the upper surface lying generally in the same plane as the upper surface of the surrounding surface material and the upper surface of the rail head.

24. A rail seal for sealing a gap between a rail and a surrounding surface material, the rail having a rail head, a rail base and a web portion interconnecting the rail head and rail base, the rail seal comprising:

an elongated elastomeric seal body;

a first surface formed along the length of the seal body for generally abutting and sealing with a corresponding side of the web portion of the rail;

a second surface formed along the length of the seal body generally opposite to the first surface, the second surface generally abutting and sealing with a corresponding edge of the surrounding surface material;

an upper surface formed along the length of the seal body, the upper surface extending between the rail head and the upper surface of the corresponding surrounding surface material; and a hinge element formed in the second surface of the seal body, the hinge element having a closed position and an open position, the hinge element comprising:

a cavity passage formed within the seal body and extending along the length thereof; and a slit formed within the elastomeric material of the seal body, the slit extending between the second surface through to the cavity passage and having opposed faces, the opposed faces being in face-to-face contact when the hinge element is in said closed position, wherein at least one anchor recess is formed in the second surface of the elongate seal body, the at least one anchor recess forming a void within the seal body for receiving an anchoring key to secure the seal body within the gap formed between the rail and the surrounding poured surface material.

25. A rail seal for sealing a gap between a rail and a surrounding surface material, the rail having a rail head, a rail base and a web portion interconnecting the rail head and rail base, the rail seal comprising:

an elongated elastomeric seal body;

a first surface formed along the length of the seal body for generally abutting and sealing with a corresponding side of the web portion of the rail;

a second surface formed along the length of the seal body generally opposite to the first surface, the second surface generally abutting and sealing with a corresponding edge of the surrounding surface material;

an upper surface formed along the length of the seal body, the upper surface extending between the rail head and the upper surface of the corresponding surrounding surface material; and a hinge element formed in the second surface of the seal body, the hinge element having a closed position and an open position, the hinge element comprising:

a cavity passage formed within the seal body and extending along the length thereof; and a slit formed within the elastomeric material of the seal body, the slit extending between the second surface through to the cavity passage and having opposed faces, the opposed faces being in face-to-face contact when the hinge element is in said closed position;

wherein at least one anchor recess is formed in the second surface of the elongate seal body, the at least one anchor recess forming a void within the seal body for receiving an anchoring key to secure the seal body within the gap formed between the rail and the surrounding poured surface material; and wherein the anchoring key is formed by poured surface material entering the void formed by the anchor recess within the seal body when the surface material is poured against the rail seal to form the surrounding surface material.

26. A rail seal for sealing a gap between a rail and a surrounding surface material, the rail having a rail head, a rail base and a web portion interconnecting the rail head and rail base, the rail seal comprising:

an elongated elastomeric seal body;

a first surface formed along the length of the seal body for generally abutting and sealing with a corresponding side of the web portion of the rail;

a second surface formed along the length of the seal body generally opposite to the first surface, the second surface generally abutting and sealing with a corresponding edge of the surrounding surface material;

an upper surface formed along the length of the seal body, the upper surface extending between the rail head and the upper surface of the corresponding surrounding surface material; and a hinge element formed in the second surface of the seal body, the hinge element having a closed position and an open position, the hinge element comprising:

a cavity passage formed within the seal body and extending along the length thereof; and a slit formed within the elastomeric material of the seal body, the slit extending between the second surface through to the cavity passage and having opposed faces, the opposed faces being in face-to-face contact when the hinge element is in said closed position;

wherein at least one anchor recess is formed in the second surface of the elongate seal body, the at least one anchor recess forming a void within the seal body for receiving an anchoring key to secure the seal body within the gap formed between the rail and the surrounding poured surface material; and wherein the anchoring key is in the form of an anchor insert inserted into the at least one anchor recess, the anchor inserts protruding outwardly from the second surface of the seal body.

* * * * *